US009751358B2

(12) United States Patent
Sferle

(10) Patent No.: US 9,751,358 B2
(45) Date of Patent: Sep. 5, 2017

(54) MARKER CAP CONNECTOR

(71) Applicant: Florina Sferle, Hendersonville, TN (US)

(72) Inventor: Florina Sferle, Hendersonville, TN (US)

( * ) Notice: Subject to any disclaimer, the term of this patent is extended or adjusted under 35 U.S.C. 154(b) by 0 days.

(21) Appl. No.: 15/167,089

(22) Filed: May 27, 2016

(65) Prior Publication Data

US 2016/0347111 A1 Dec. 1, 2016

Related U.S. Application Data

(60) Provisional application No. 62/168,056, filed on May 29, 2015.

(51) Int. Cl.
*B43K 27/08* (2006.01)
*B43K 23/12* (2006.01)

(52) U.S. Cl.
CPC ..... *B43K 27/08* (2013.01); *B43K 23/12* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,252,450 | B2 * | 8/2007 | Aguirre | A44C 5/0046 224/267 |
| 7,377,708 | B2 * | 5/2008 | Hageman | B43K 23/008 401/131 |
| 7,563,047 | B2 * | 7/2009 | Paluda | B43K 23/001 401/131 |
| 8,801,311 | B1 * | 8/2014 | Miller | B43K 23/02 24/298 |
| 9,182,072 | B1 * | 11/2015 | Holmes | A47L 13/512 |

* cited by examiner

*Primary Examiner* — David Walczak
(74) *Attorney, Agent, or Firm* — Dunlap Bennett & Ludwig PLLC

(57) ABSTRACT

A cap connector. The cap connector includes an elongated cord. The present invention further includes a plurality of caps. Each cap may include a first end having a rim forming an opening leading into the cap and a second end. An aperture is formed through the second end of the cap. The elongated cord runs through each of the apertures of each of the caps, thereby securing the caps together and to the cord.

7 Claims, 3 Drawing Sheets

MARKER CAP CONNECTOR

CROSS-REFERENCE TO RELATED APPLICATION

This application claims the benefit of priority of U.S. provisional application No. 62/168,056, filed May 29, 2015, the contents of which are herein incorporated by reference.

BACKGROUND OF THE INVENTION

The present invention relates to markers and, more particularly, to a marker connector.

A marker pen is a pen which has its own ink-source, and usually a tip made of porous, pressed fibers such as felt. Children enjoy using markers to color coloring books and to draw pictures. Marker pens have releasable caps that may be easily lost or misplaced.

As can be seen, there is a need for a system to prevent the caps from being lost or misplaced.

SUMMARY OF THE INVENTION

In one aspect of the present invention, an apparatus comprises: an elongated cord; and a plurality of caps, wherein each cap comprises a first end and a second end, wherein the first end comprises a rim forming an opening leading into the cap, and the second end comprises at least one aperture, wherein the elongated cord runs through the aperture of each of the plurality of caps, thereby securing the plurality of caps to the cord.

In another aspect of the present invention, a method of attaching writing utensils together comprises: forming an aperture through a plurality of caps of a plurality of writing utensils; running a cord through each of the apertures of the plurality of caps; and connecting a first end of the cord to a second end of the cord forming an endless loop.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
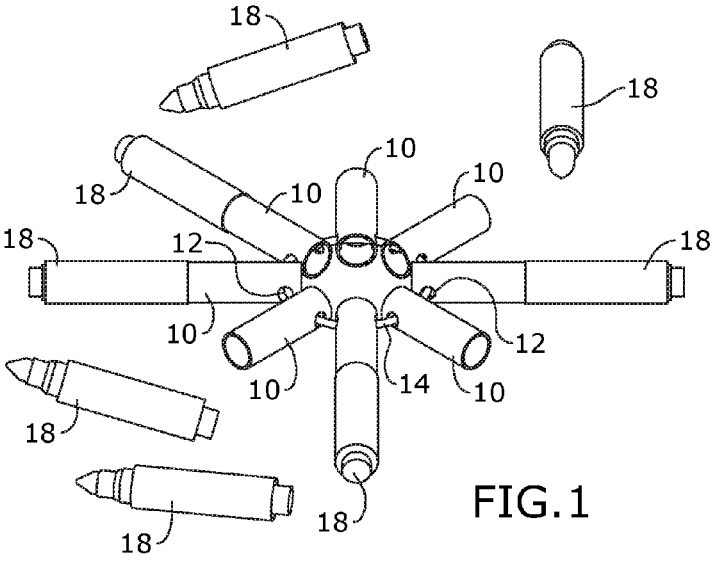
FIG. 1 is a perspective view of an embodiment of the present invention illustrated with some markers removed from some caps.
Figure 2:
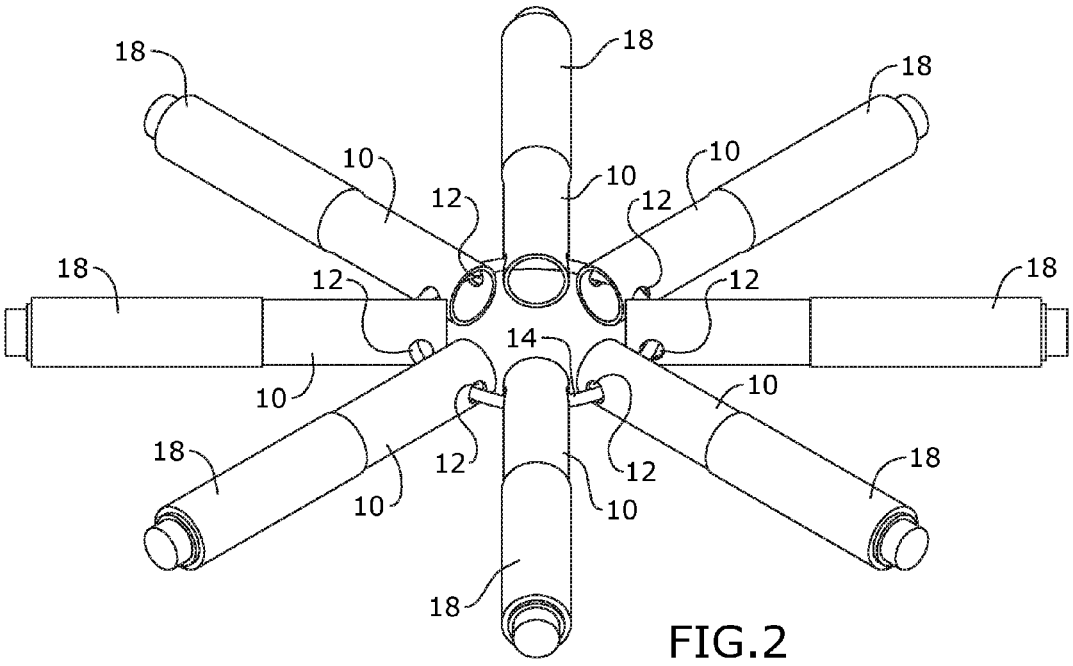
FIG. 2 is a perspective view of an embodiment of the present invention.
Figure 3:
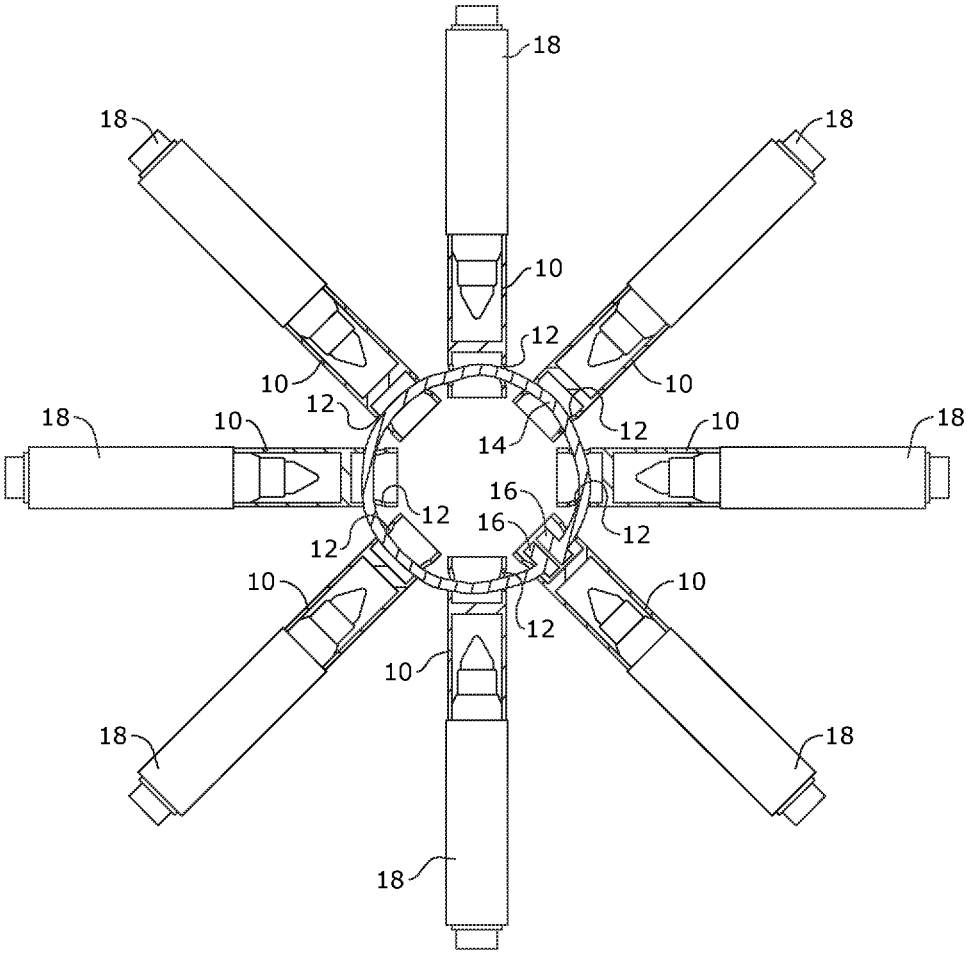
FIG. 3 is a section view of an embodiment of the present invention.
Figure 4:
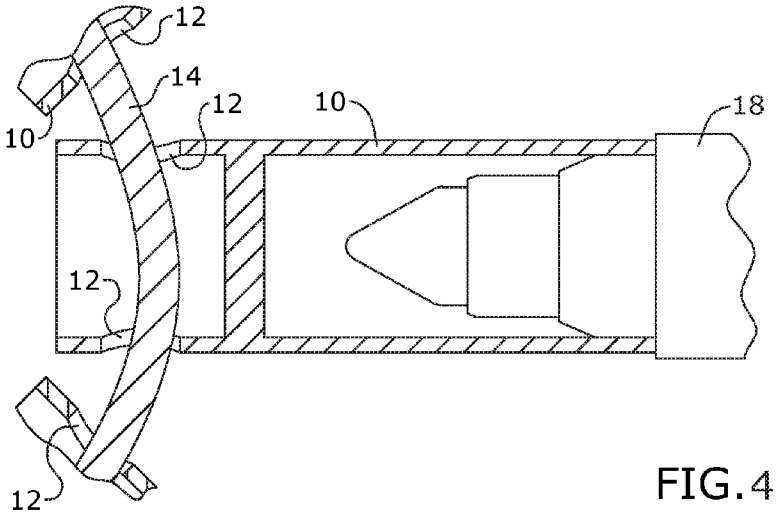
FIG. 4 is a detail section view of an embodiment of the present invention.
Figure 5:
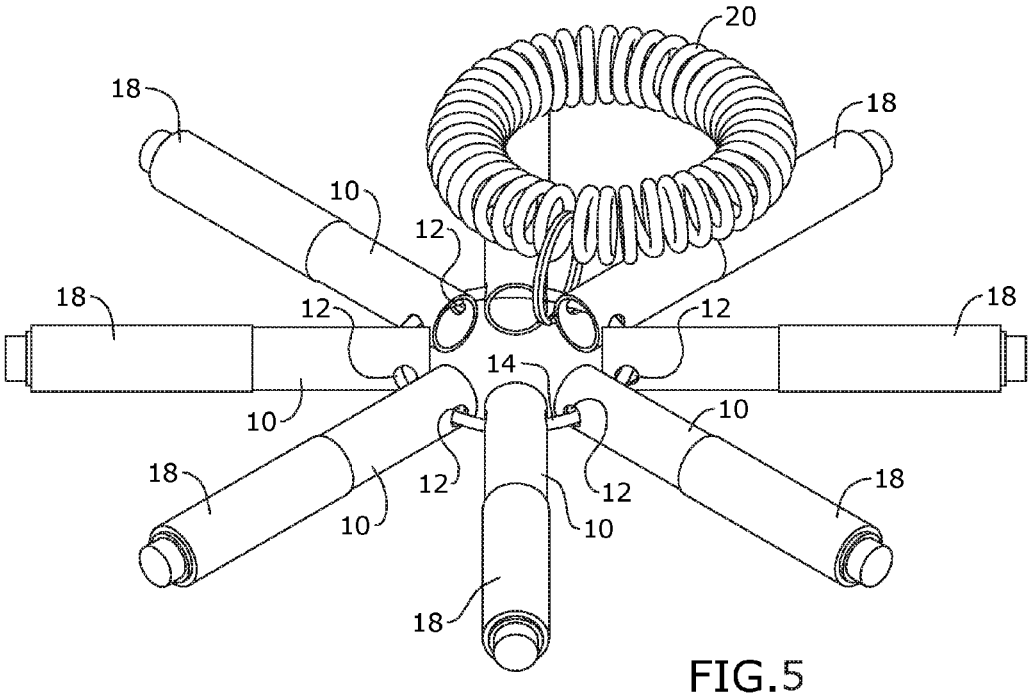
FIG. 5 is a perspective view of an embodiment of the present invention, illustrated with a carrying ring.

Referring to FIGS. 1 through 5, the present invention includes a cap connector. The cap connector includes an elongated cord 14. The present invention further includes a plurality of caps 10. Each cap 10 may include a first end having a rim forming an opening leading into the cap 10 and a second end. An aperture 12 is formed through the second end of the cap 10. The elongated cord 14 runs through each of the apertures 12 of each of the caps 10, thereby securing the caps 10 together and to the cord 14.

The caps 10 of the present invention may include a cylinder shaped sidewall having a first end and a second end. Each of the caps 10 further include a rim at the first end forming an opening leading into a hollow core. The rim of the first end is securable to a writing utensil 18. The second end may also include a rim forming an opening leading into an opposing side of the cap 10. A divider may be disposed within the cylinder shaped cap 10. The divider separates an upper compartment from a lower compartment. The aperture 12 may be formed through the sidewall of the cap 10 at the upper compartment. The aperture 12 may be substantially perpendicular to the opening formed by the rim, and may be disposed in between the opening and the divider. In certain embodiments, an aperture 12 may be formed on each side of the sidewall of each cap 10. The apertures 12 may align with one another, and the cord 14 may fit though the aligned openings.

The present invention may further include a plurality of writing utensils 18. The writing utensils 18 may each include a first end and a second end. The first ends may each include a writing tip. The caps 10 may fit over the writing tip and releasably secure to the first end of the writing utensils. In certain embodiments, the writing utensils 18 may be markers. However, the present invention is not limited to markers, and may include pens, highlighters, and other writing utensils 18 that utilize a cap.

The elongated cord 14 of the present invention may be made of any appropriate bendable or flexible material. For example, the elongated cord 14 may be made of fabric, such as cotton, hemp, polyester and the like, or a polymer, such as rubber, silicone and the like. In certain embodiments, the elongated cord 14 may form an endless loop. In such embodiments, a first end of the elongated cord 14 is connected with a second end of the endless cord 14. The present invention may further include a first stopper 16 at a first end and a second stopper 16 at a second end. Each of the first stopper 16 and the second stopper 16 may include a larger diameter than the apertures 14 and may be disposed within one of the caps 10. Alternatively, the first end and the second end may be disconnected. In such embodiments, the stopper 16 may be disposed at each end of the elongated cord 14 and may be located outside of the caps 10 to prevent the caps 10 from detaching. For example, a knot may be tied, or an object may be attached to the ends.

The present invention may further include a carrying ring 20. The carrying ring 20 may include a metal loop secured around the elongated cord 14 and a scrunchie bracelet secured to the metal loop. The carrying ring 20 allows users to carry the present invention around their wrist.

A method of attaching writing utensils together may include the following steps: forming an aperture through a plurality of caps of a plurality of writing utensils; running a cord through each of the apertures of the plurality of caps; and connecting a first end of the cord to a second end of the cord forming an endless loop. The method may further include the step of securing a carrying ring to the elongated cord.

It should be understood, of course, that the foregoing relates to exemplary embodiments of the invention and that modifications may be made without departing from the spirit and scope of the invention as set forth in the following claims.

What is claimed is:

1. An apparatus comprising:

an elongated cord;

a plurality of caps, wherein each cap comprises a cylinder shaped sidewall having a first end and a second end, each cap further comprising a rim at the first end forming an opening leading into a hollow core of the cap and a divider disposed within the hollow core separating an upper compartment from a lower compartment, wherein a first aperture and a second aperture are formed through the upper compartment at opposing sides of the sidewall, the first aperture and the second aperture being aligned with one another and having a gap formed therebetween; and a plurality of writing utensils each comprising a first end comprising a writing tip, wherein the first end of each of the plurality of writing utensils is releasably attached to the first end of one of the plurality of caps so that the writing tip is disposed within the lower compartment, wherein the elongated cord runs through the first aperture and the second aperture of each of the plurality of caps, thereby securing the plurality of caps to the cord.

2. The apparatus of claim 1, wherein the plurality of writing utensils are each a marker.

3. The apparatus of claim 1, wherein the elongated cord comprises an endless loop.

4. The apparatus of claim 1, further comprising a carrying ring secured to the elongated cord.

5. A method of attaching writing utensils together comprising the steps of:

providing a plurality of caps, wherein each cap comprises a cylinder shaped sidewall having a first end and a second end, each cap further comprising a rim at the first end forming an opening leading into a hollow core of the cap, and a divider disposed within the hollow core separating an upper compartment from a lower compartment;

forming a first aperture and a second aperture through each of the plurality of caps, wherein the first aperture and the second aperture are formed through the upper compartment at opposing sides of the sidewall, the first aperture and the second aperture being aligned with one another and having a gap formed therebetween;

providing a plurality of writing utensils having a first end comprising a writing tip;

attaching each of said writing utensils to a respective one of said caps so that the writing tip is disposed in the lower compartment;

running a cord through the first aperture and the second aperture of each of the plurality of caps; and connecting a first end of the cord to a second end of the cord forming an endless loop.

6. The method of claim 5, wherein the plurality of writing utensils are each a marker.

7. The method of claim 5, further comprising the step of securing a carrying ring to the elongated cord.

* * * * *